US006079234A

United States Patent [19]

Hsiung

[11] Patent Number: 6,079,234

[45] Date of Patent: Jun. 27, 2000

[54] YARN FEEDER FOR A JACQUARD KNITTING MACHINE

[76] Inventor: Ching-Lung Hsiung, 4F., No. 130, Chungsan Rd., Sanchung City, Taipei Hsien, Taiwan

[21] Appl. No.: 09/292,390

[22] Filed: Apr. 15, 1999

[51] Int. Cl.[7] ..... D04B 15/48

[52] U.S. Cl. ..... 66/132 R; 66/125 R; 226/174

[58] Field of Search ..... 66/132 R, 133, 66/134, 157; 226/174, 66; 242/419.1, 420.3, 420.1

[56] References Cited

U.S. PATENT DOCUMENTS

| | | | |
|---|---|---|---|
| 4,673,139 | 6/1987 | Memminger et al. | 242/47.01 |
| 4,706,476 | 11/1987 | Memminger et al. | 66/132 R |
| 4,890,464 | 1/1990 | Tsuchiya et al. | 66/132 T |
| 4,986,316 | 1/1991 | Morohashi et al. | 66/132 |
| 5,388,747 | 2/1995 | Chen | 66/132 |

*Primary Examiner*—Larry Worrell
*Attorney, Agent, or Firm*—Varndell & Varndell, PLLC

[57] ABSTRACT

In a yarn feeder used in a jacquard knitting machine, each yarn tension bracket includes a casing covered with a cover plate, a pivot shaft supported on bearings between the casing and the cover plate, a yarn tension rocker formed of two wire rods respectively fastened to two opposite round pins at two opposite ends of the pivot shaft outside the casing and the cover plate and turned with the pivot shaft to adjust the tension of yarns passing through upper and lower thread eyes at the wire rods, and an auxiliary yarn guide with upper and lower thread eyes fastened to the casing and the cover plate to guide two yarns passing through the upper and lower thread eyes at the yarn tension rocker and to prevent the yarns from being tangled.

2 Claims, 9 Drawing Sheets

YARN FEEDER FOR A JACQUARD KNITTING MACHINE

BACKGROUND AND SUMMARY OF THE INVENTION

The present invention relates to a yarn feeder for a jacquard knitting machine, and more particularly to a yarn tension bracket for use in a yarn feeder in a jacquard knitting machine which is durable in use and, has auxiliary yarn guide means that prevent yarns from being tangled.

FIG. 1 shows a yarn feeder for a jacquard knitting machine according to the prior art. FIGS. 2 and 3 show another structure of yarn feeder according to U.S. Pat. No. 5,388,747. These yarn feeders are not satisfactory in function. One drawback of these yarn feeders is that the pivot hole at the casing of each yarn tension bracket to which a respective yarn tension rod is pivotably connected wears quickly with use, casing the respective yarn tension rod to vibrate during yarn feeding operation. Another drawback of these yarn feeders is that the yarns which come out of the left thread eyes at the locating plate and then pass through the yarn guide wheels and the right thread eyes at the locating plate tend to be tangled. Because the left thread eyes and the right thread eyes are respectively horizontally aligned, each two yarns which are delivered through one left thread eye and one right thread eye at same elevation will rub against each other during feeding.

The present invention has been accomplished to provide a yarn feeder for a jacquard knitting machine which eliminates the aforesaid drawbacks. According to one aspect of the present invention, each yarn tension bracket which guides two yarns to upper and lower thread grooves at a respective yarn guide wheel comprises a casing covered with a cover plate, a pivot shaft supported on bearings between the casing and the cover plate, and a yarn tension rocker formed of two wire rods respectively fastened to two opposite round pins at two opposite ends of the pivot shaft outside the casing and the cover plate and turned with the pivot shaft, by means of the control of an adjustment screw, to adjust the tension of yarns passing through upper and lower thread eyes at the wire rods. According to another aspect of the present invention, an auxiliary yarn guide which comprises an upper thread eye and a lower thread eye is fastened to the casing and the cover plate to guide two yarns passing through the upper and lower thread eyes at the yarn tension rocker and to prevent the yarns from being tangled. According to still another aspect of the present invention, the auxiliary yarn guide comprises a U-clamp that can conveniently be fastened to the casing and cover plate.

DETAILED DESCRIPTION OF THE PREFERRED EMBODIMENT

Figure 1:
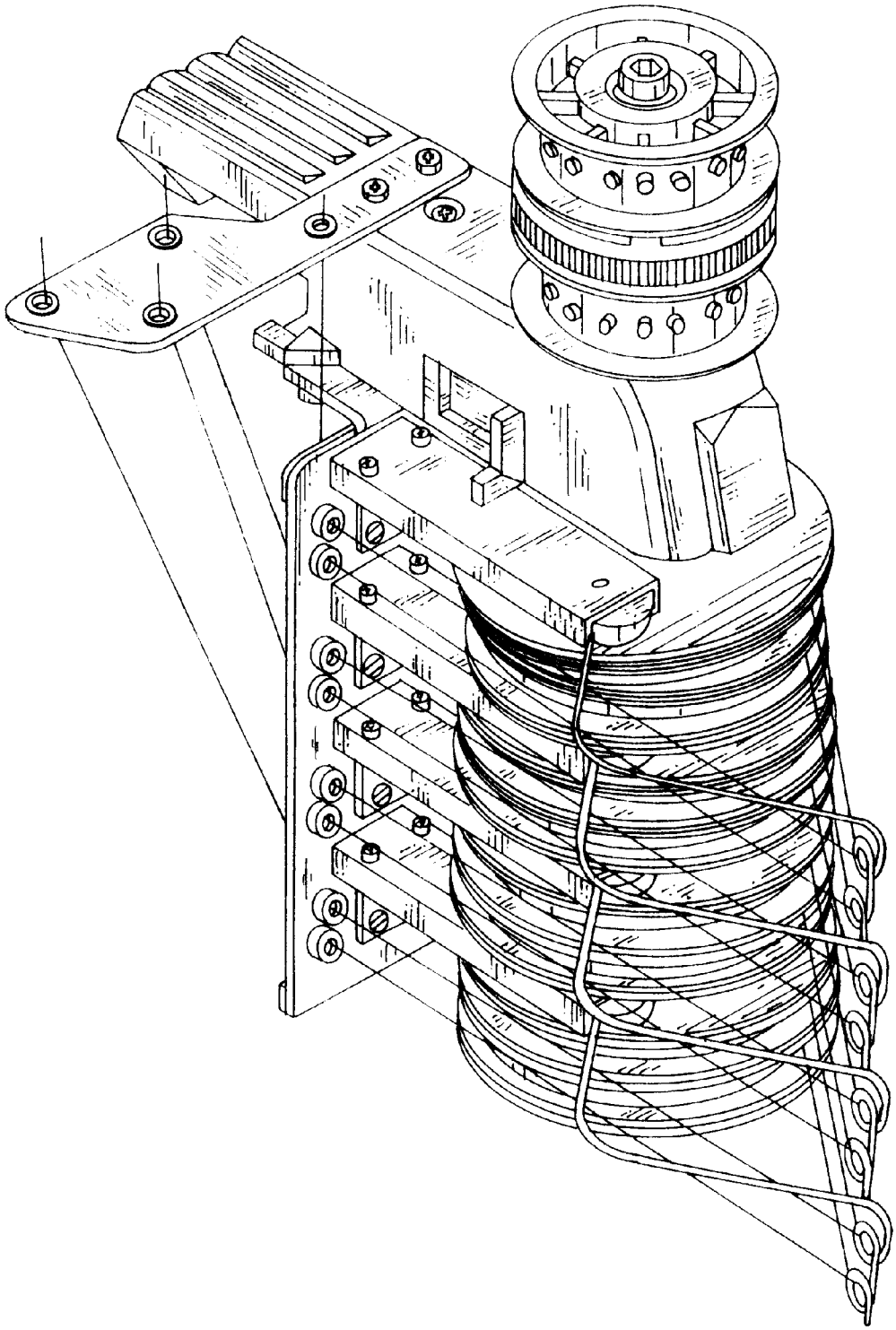
Fig. 1 PRIOR ART
FIG. 1 is a perspective view of a yarn feeder according to the prior art.
Figure 2:
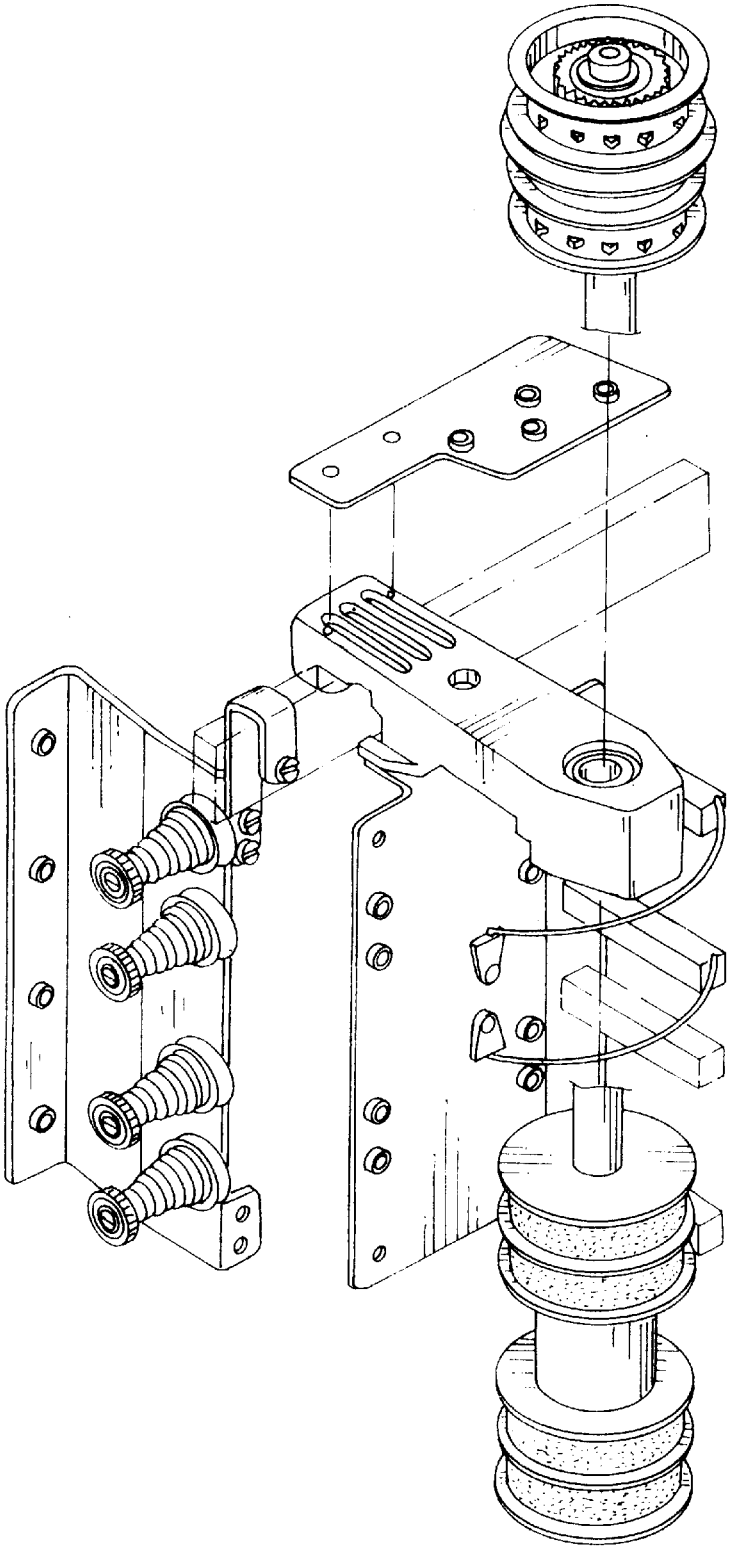
Fig. 2 PRIOR ART
FIG. 2 is an exploded view of another structure of yarn feeder according to the prior art.
Figure 3:
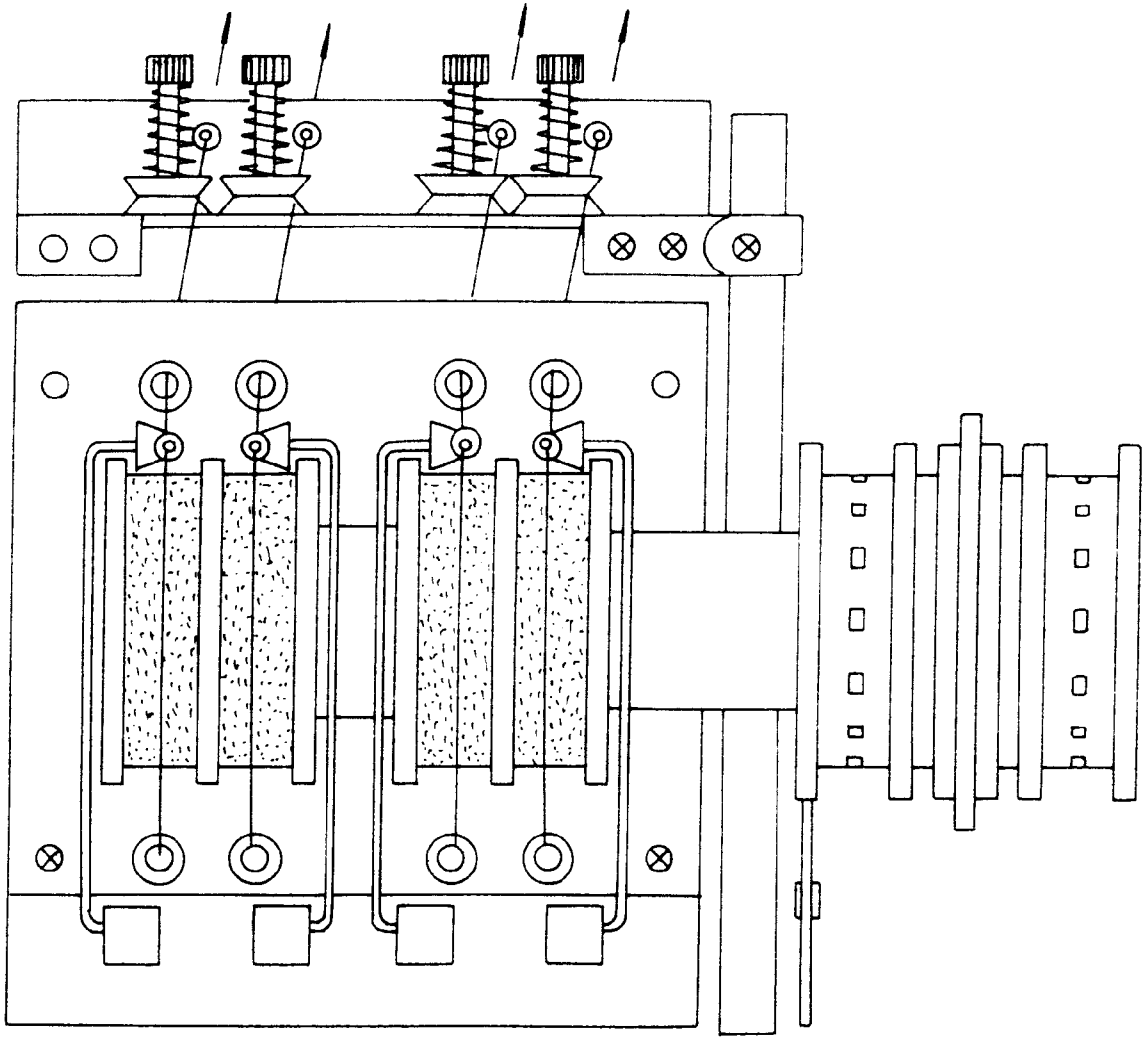
Fig. 3 PRIOR ART
FIG. 3 is a back side plain view of the yarn feeder shown in FIG. 2.
Figure 4:
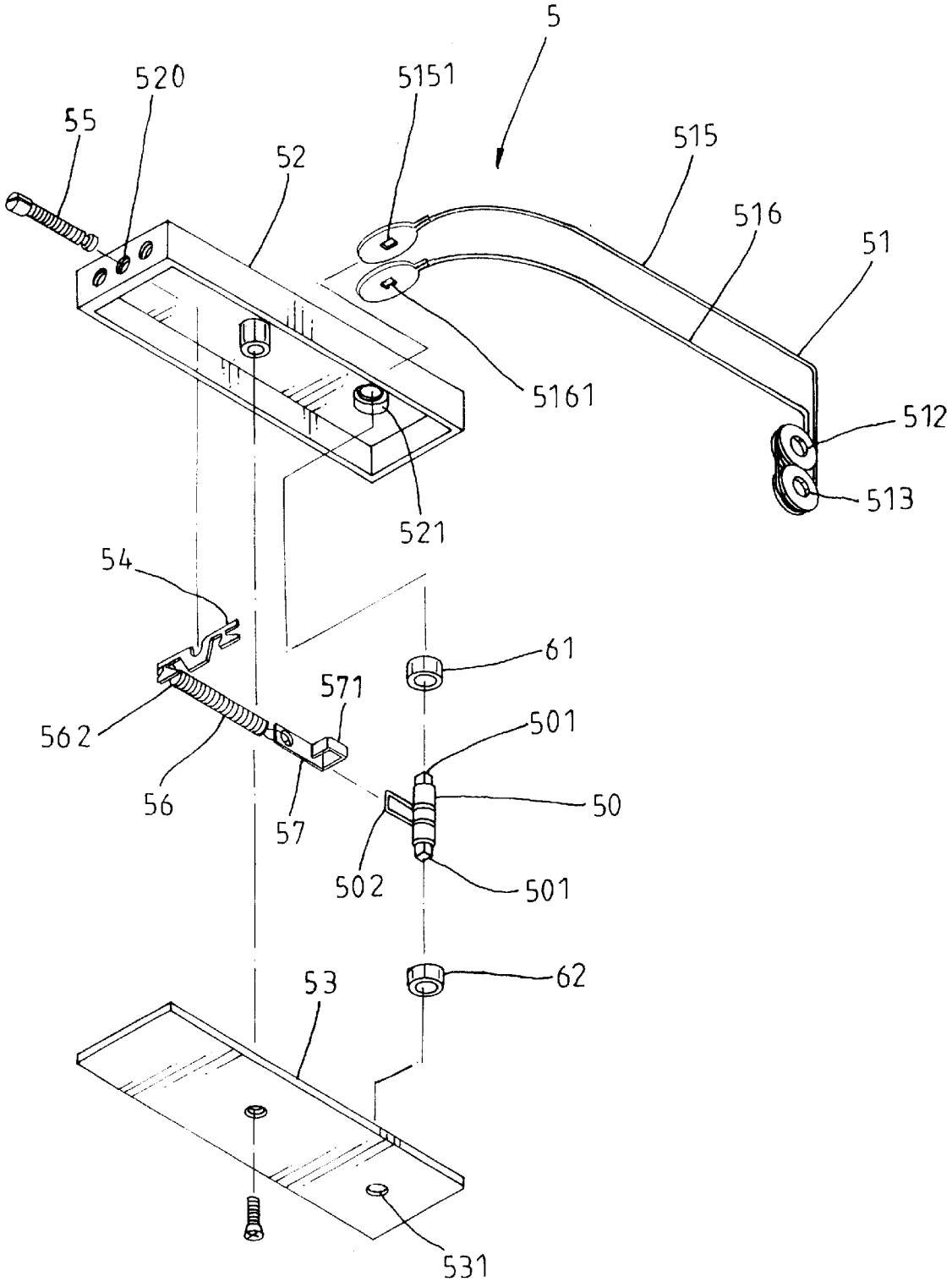
FIG. 4 is an exploded view of a yarn tension bracket according to the present invention (the auxiliary yarn guide excluded).
Figure 5:
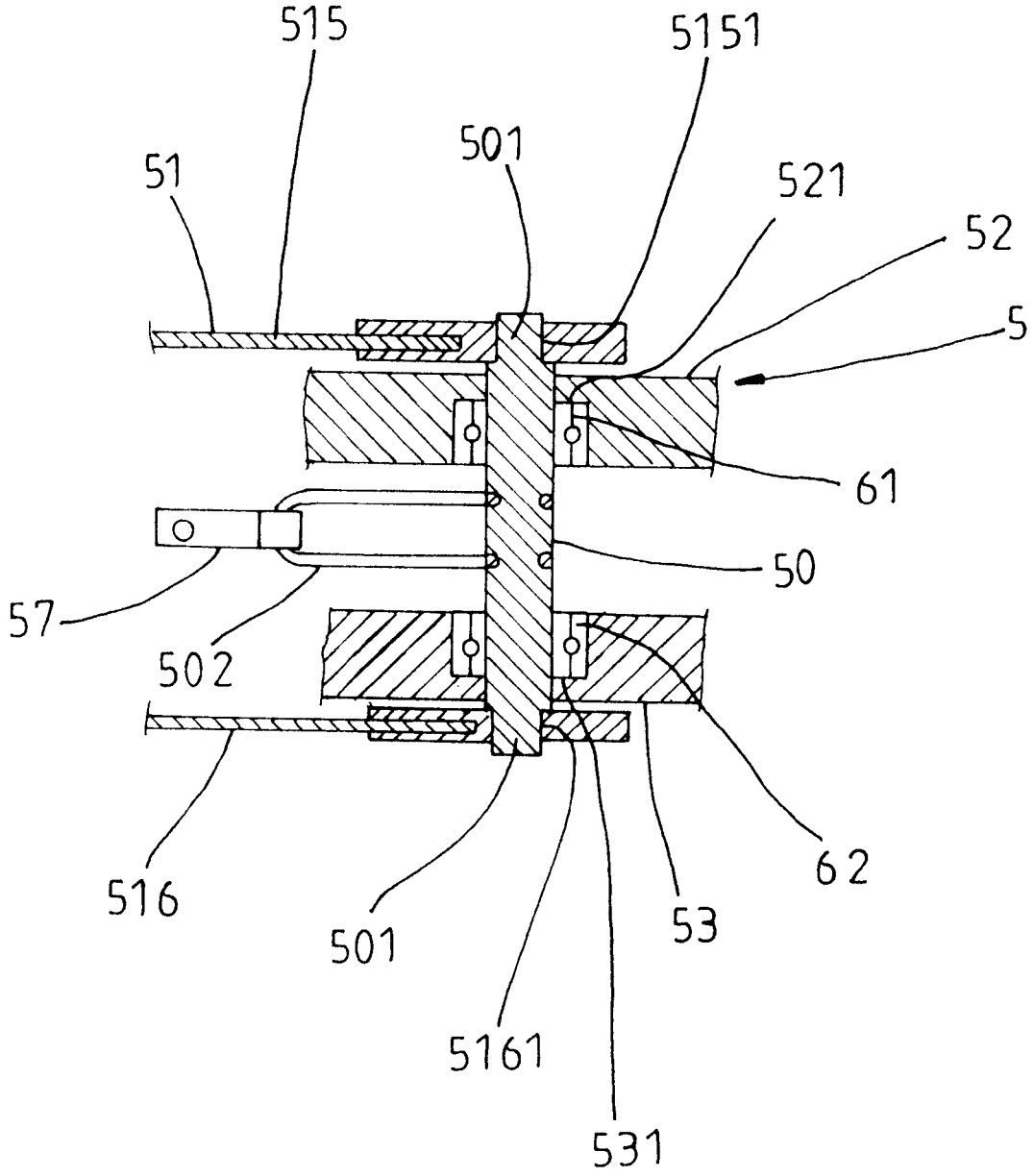
FIG. 5 is a sectional assembly view in an enlarged scale of a part of the yarn tension bracket according to the present invention.
Figure 6:
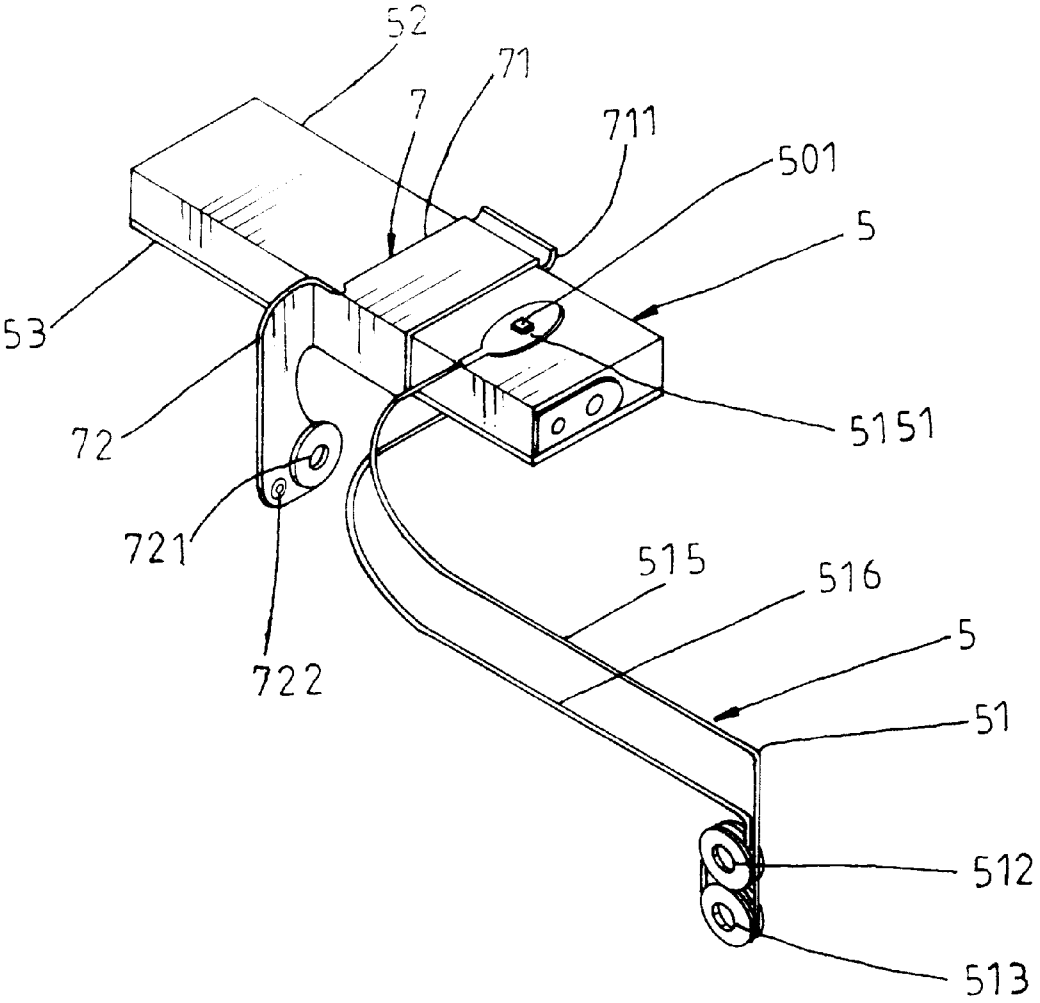
FIG. 6 is a perspective view of the yarn tension bracket according to the present invention.
Figure 7:
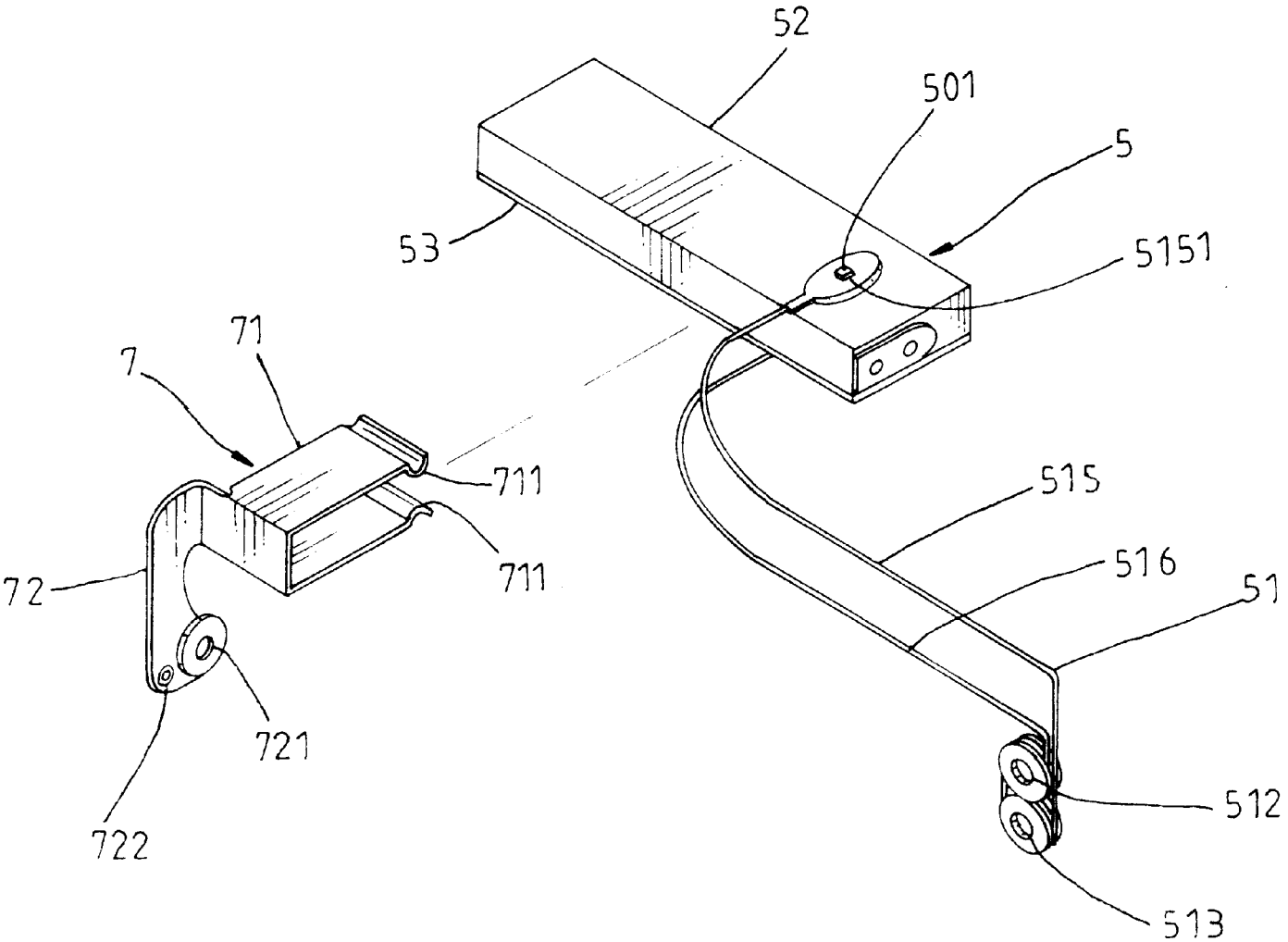
FIG. 7 is similar to FIG. 6 but showing the auxiliary yarn guide disconnected from the casing.
Figure 8:
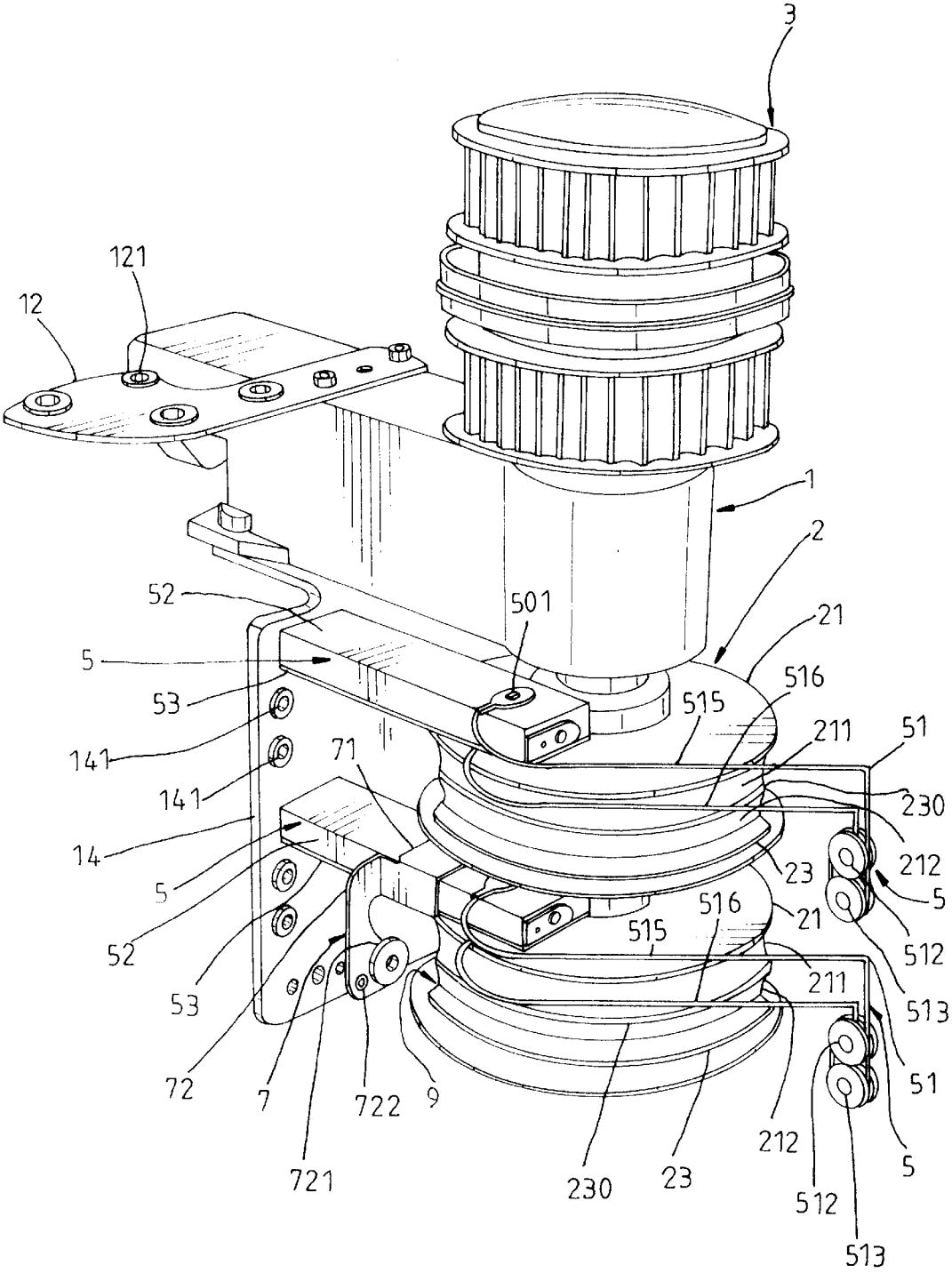
FIG. 8 is a perspective view of a yarn feeder for a jacquard knitting machine according to the present invention.
Figure 9:
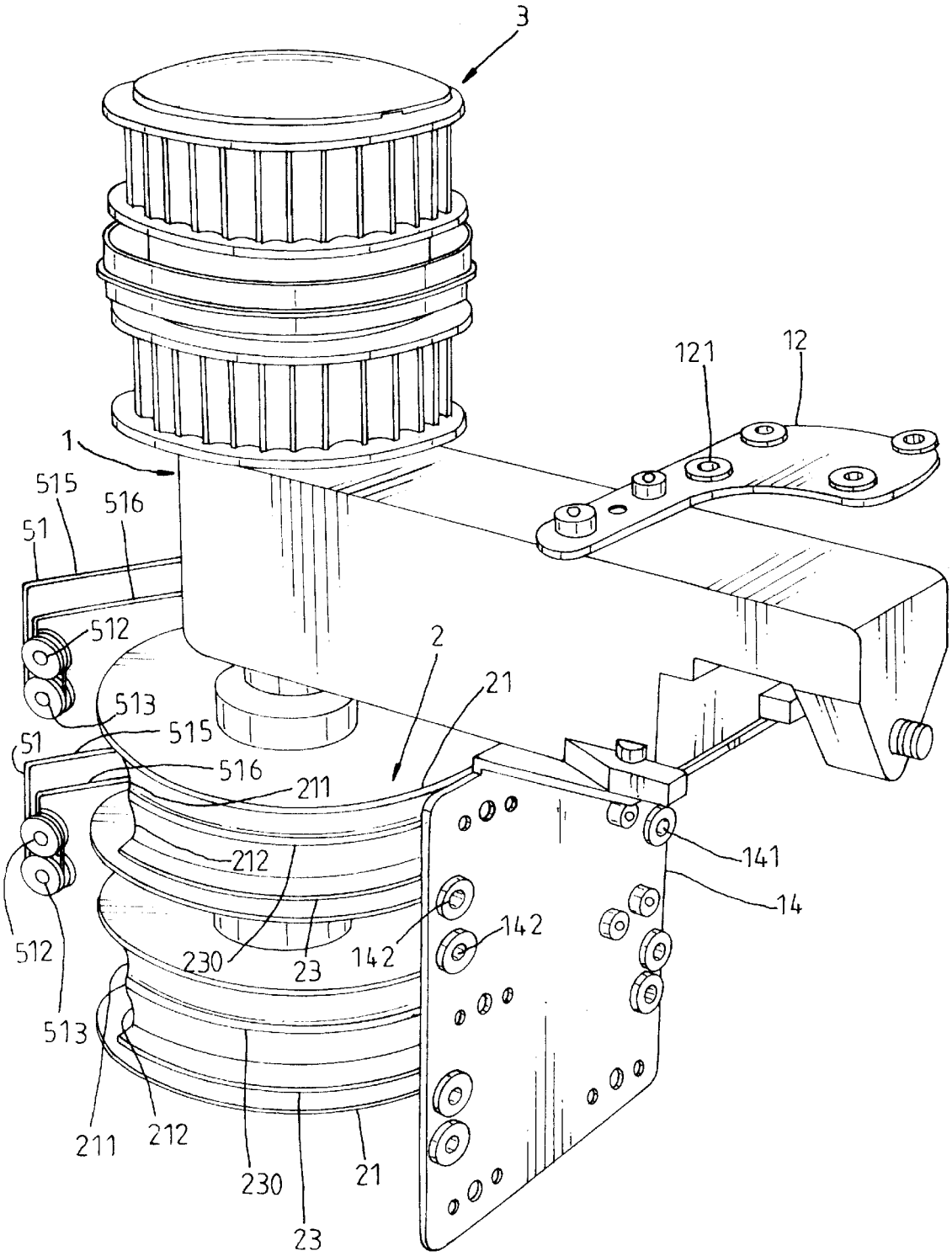
FIG. 9 is a perspective view of the yarn feeder shown in FIG. 8 when view from another angle.

Referring to FIGS. from 4 through 9, a yarn feeder for a jacquard knitting machine is shown comprised of a base frame 1 fixedly fastened to a part of the jacquard knitting machine (not shown), a horizontal plate 12 fixedly fastened to the base frame 1 at the top, the horizontal plate 12 having a plurality of thread eyes 121, a drive wheel 3 mounted on the base frame 1 at the top, a locating plate 14 fixedly fastened to the base frame 1 at the bottom, the locating plate 14 having two parallel rows of vertically spaced thread eyes 141 and 142 (see FIG. 9), and a yarn guide wheel unit 2 suspended below the base frame 1 and coupled to the drive wheel 3, and a plurality of yarn tension brackets 5. The yarn guide wheel unit 2 is comprised of a plurality of yarn guide wheels 21, and a plurality of rubber band 23 respectively mounted on the yarn guide wheels 21. The rubber band 23 forms an annular convex portion 230 around the periphery of the respective yarn guide wheel 21. The annular convex portion 230 divides the recessed peripheral wall of the respective yarn guide wheel 21 an upper thread groove 211 and a lower thread groove 212.

The yarn tension brackets 5 are fixedly fastened to the locating plate 14 at one side at different elevational corresponding to the yarn guide wheels 21, each comprised of a yarn tension rocker 51, a casing 52, a cover plate 53, an adjustment plate 54, an adjustment screw 55, a spring member 56, and a connecting plate 57. The yarn tension rocker 51 is pivoted to the casing 52, having an upper thread eye 512 and a lower thread eye 513 arranged at one end remote from the casing 52. The fixed end of the yarn tension rocker 51 is connected to one end of the connecting plate 57 inside the casing 52. The other end of the connecting plate 57 is connected to one end of the spring member 56. The other end 562 of the spring member 56 is connected to the adjustment plate 54 is disposed inside the casing 52, and connected to the spring member 56. The adjustment screw 55 is threaded into a screw hole 520 at one end of the casing 52 remote from the yarn tension rocker 51, and connected to the adjustment plate 54. By means of rotating the adjustment screw 55 in the screw hole 520 to move the adjustment plate 54, the spring force of the spring member 56 is adjusted, and therefore the tension of the yarn tension rocker 51 is relatively adjusted.

Referring to FIGS. from 4 through 7 again, the casing 52 has a countersunk hole 521 near its one end. The cover plate 53 has a countersunk hole 531 near its one end corresponding to the countersunk hole 521 at the casing 52. Two bearings 61 and 62 are respectively mounted in the countersunk hole 521 at the casing 52 and the countersunk hole 531 at the cover plate 53. A pivot shaft 50 is supported on the bearings 61 and 62 between the casing 52 and the cover plate 53, having two round pins 501 axially extended from its two opposite ends in reversed directions and respectively inserted through the bearings 61 and 62. The yarn tension rocker 51 is comprised of a first wire rod 515 and a second wire rod 516. The aforesaid upper thread eye 512 and lower thread eye 513 are respectively formed integral with the second wire rod 516 and the first wire rod 515 at one end.

The first wire rod 515 has an opposite end terminating in an eye end 5151 fastened to one round pin 501 of the pivot shaft 50 and suspended above the casing 52. The second wire rod 516 has an opposite end terminating in an eye end 5161 fastened to the other round pin 501 of the pivot shaft 50 and suspended below the cover plate 53. A substantially U-shaped rod 502 is fixedly mounted on the pivot shaft 50 on the middle, and hooked on a hooked portion 571 at one end of the connecting plate 57. Because the pivot shaft 50 is supported between the bearings 61 and 62, it can be rotated smoothly without causing much friction resistance. When the pivot shaft 50 is rotated, the yarn tension rocker 51 is moved with the pivot shaft 50 relative to the casing 52.

Referring to FIGS. from 6 through 9 again, an auxiliary yarn guide 7 is fastened to each yarn tension bracket 5. The auxiliary yarn guide 7 comprises a U-clamp 71 clamped on the top side of the casing 52 and the bottom side of the cover plate 53, and a suspension plate 72 extended from the U-clamp 71. The U-clamp 71 has two parallel walls terminating in a respective retaining portion 711 for securing the U-clamp 71 to the casing 52 and cover plate 53 of the respective yarn tension bracket 5. The suspension plate 72 comprises an upper thread eye 721 and a lower thread eye 722. The center point of the upper thread eye 721 is horizontally aimed at the midpoint 9 at the lower thread groove 212 at the corresponding yarn guide wheel 21 (see FIG. 9). The lower thread eye 722 is disposed at a lower elevation than the upper thread eye 721, however the upper thread eye 721 and the lower thread eye 722 are not vertically aligned. When in use, yarns are respectively extended through one row of thread eyes 141 at the locating plate 14, the upper thread groove 211 at each of the yarn guide wheels 21, and the upper thread eye 721 at the auxiliary yarn guide 7 at each of the yarn tension brackets 5, and then extended through the lower thread groove 212 at each of the yarn guide wheels 21 and then the other row of thread eyes 142 at the locating plate 14. Therefore, installed yarns are smoothly guided forwards. When actively feeding yarns for knitting, yarns are delivered through one row of thread eyes 141 at the locating plate 14, then wound round the upper thread groove 211 through one turn, and then delivered through the upper thread eye 721 at the auxiliary yarn guide 7 at each of the yarn tension brackets 5, and then delivered through the lower thread groove 212 at each of the yarn guide wheels 21, and then delivered through the lower thread eye 722 at the auxiliary yarn guide 7 at each of the yarn tension brackets 5, and then wound round the lower thread groove 212 through one turn, and then delivered through the other row of thread eyes 142 at the locating plate 14. Because the center of the upper thread eye 721 at the auxiliary yarn guide 7 at each of the yarn tension brackets 5 is obliquely spaced from the center of the lower thread eye 722 at the respective auxiliary yarn guide 7 at a distance, feeding yarns are well separated from one another, and prohibited from being tangled.

What is claimed is:

1. A jacquard knitting machine comprising a yarn feeder, the yarn feeder including:

a base frame fixedly fastened to a part of the jacquard knitting machine;

a horizontal plate fixedly fastened to said base frame at a top side, said horizontal plate having a plurality of thread eyes for guiding yarns;

a drive wheel mounted on said base frame at a top side;

a locating plate fixedly fastened to said base frame at a bottom side, said locating plate having two parallel rows of vertically spaced thread eyes for guiding yarns;

a yarn guide wheel unit suspended below said base frame and coupled to said drive wheel, said yarn guide wheel unit comprised of a plurality of yarn guide wheels, and a plurality of rubber bands respectively mounted on said yard guide wheels, said yarn guide wheels each having a recessed peripheral wall, the rubber band at each of said yarn guide wheels forming an annular convex portion around the periphery of the respective yarn guide wheel and dividing the recessed peripheral wall of the respective yard guide wheel into an upper thread groove and a lower thread groove; and a plurality of yarn brackets fixedly fastened to said locating plate at one side at different elevations corresponding to said yarn guide wheels, said yard tension brackets each comprised of a yarn tension rocker, a casing, a cover plate, an adjustment plate, an adjustment screw, a spring member, and a connecting plate, said yarn tension rocker being pivoted to said casing and having an upper thread eye and a lower thread eye arranged at one end remote from said casing, said casing having a screw hole at one end thereof, said connecting plate having one end connected to said yarn tension rocket and an opposite end connected to said spring member inside said casing, said spring member having one end connected to said connecting plate inside said casing and an opposite end connected to said adjustment plate, said adjustment plate being disposed inside said casing and connected to said spring member, said adjustment screw being threaded into the screw hole at one end of said casing and connected to said adjustment plate and rotated in said screw hole to adjust the spring force of said spring member, enabling the tension of said yarn tension rocker to be adjusted, wherein:

said casing comprises a countersunk hole and a bearing mounted in the countersunk hole at said casing;

said cover plate comprises a countersunk hole and a bearing mounted in the countersunk hole at said cover plate;

a pivot shaft is supported on the bearing at said casing and the bearing at said cover plate, said pivot shaft comprising a first round pin and a second round pin respectively axially extended from two opposite ends thereof in reversed directions and respectively inserted through the bearing at said casing and the bearing at said cover plate, and a U-shaped rod perpendicularly raised from the periphery thereof and hooked on one end of said connecting plate;

the yarn tension rocker of each of said yarn tension brackets comprises a first wire rod and a second wire rod, said first wire rod having a first end terminating in an eye end fastened to the first round pin of said pivot shaft and suspended above said casing and a second end suspended outside said casing, said second wire rod having a first end terminating in an eye end fastened to the second round pin of said pivot shaft and suspended below said cover plate and a second end suspended outside said casing and said cover plate; and the lower thread eye and upper thread eye of the yarn tension rocker of each of said yarn tension bracket are respectively formed integral with the second end of the first wire rod and the second end of the second wire rod of the yarn tension rocker of the corresponding yarn tension bracket.

2. The jacquard knitting machine of claim 1, wherein said yarn tension brackets each comprise an auxiliary yarn guide, said auxiliary yarn guide comprising a U-clamp clamped on the casing and cover plate of the respective yarn tension bracket, and a suspension plate extended from said U-clamp, said suspension plate comprising an upper thread eye and a lower thread eye, the center point of the upper thread eye of said auxiliary yarn guide being horizontally aimed at the midpoint at the lower thread groove at the corresponding yarn guide wheel, the lower thread eye and upper thread eye of said auxiliary yarn guide being not vertically aligned, the lower thread eye of said auxiliary yarn guide being disposed at a lower elevation than the upper thread eye of said auxiliary yarn guide.

* * * * *